US005348178A

United States Patent [19]

McLain

[11] Patent Number: 5,348,178

[45] Date of Patent: Sep. 20, 1994

[54] CONTAINER SYSTEMS FOR HIGH EXPLOSIVE TEST AGENTS

[75] Inventor: Clifford E. McLain, Fairfax Station, Va.

[73] Assignee: ARES Corporation, Arlington, Va.

[21] Appl. No.: 986,513

[22] Filed: Jan. 25, 1993

[51] Int. Cl.[5] ..... F42B 37/00

[52] U.S. Cl. ..... 220/88.1

[58] Field of Search ..... 220/88.1; 206/583, 524.1, 206/524.3, 524.4; 149/124

[56] References Cited

U.S. PATENT DOCUMENTS 2,335,779 11/1943 Mazzei ..... 206/524.1 X
4,248,342 2/1981 King et al. ..... 220/88.1 X
5,267,665 12/1993 Sanai et al. ..... 220/88.1

*Primary Examiner*—Steven M. Pollard

[57] ABSTRACT

A container system which can provide for a wide variety of explosive charge configurations, including a suspended spherical or elliptical charge, using a container system which provides minimum interference with the action of the explosive agent while allowing the use of inexpensive liquid or pourable explosive agents. An important property of the invention is that of introducing a minimum of contamination into the blast field created by the detonation of the explosive agent. Therefor it is an objective of the invention to impose a minimum of non-explosive mass of the container system upon the overall mass of the system and its explosive agents.

9 Claims, 17 Drawing Sheets

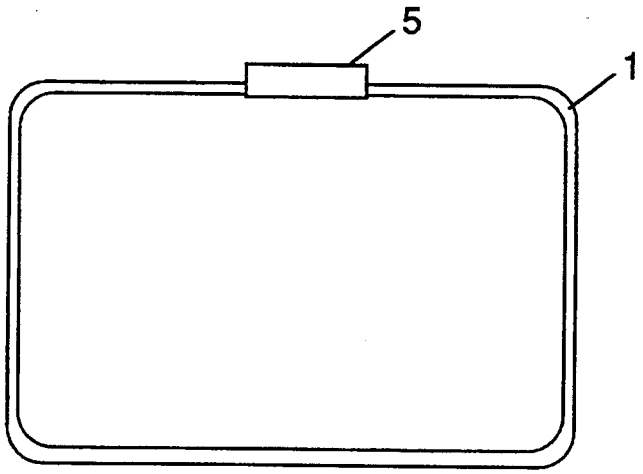
Figure 1.a
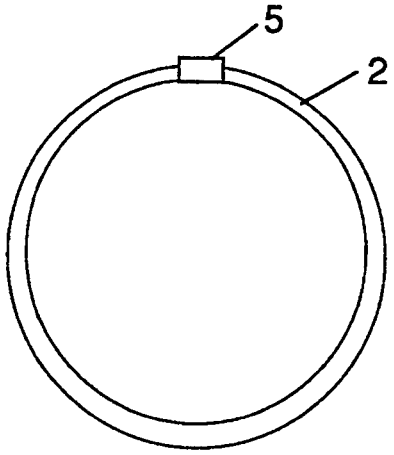
Figure 1.b
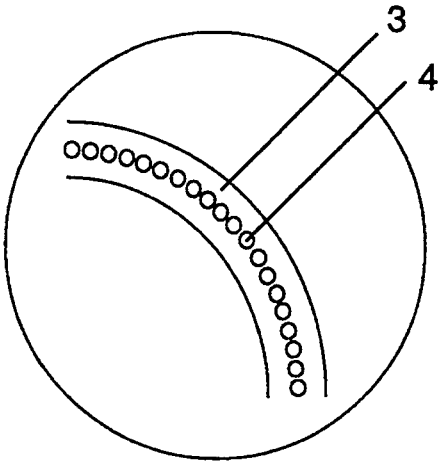
Figure 1.c

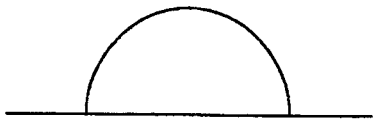
Figure 3.a
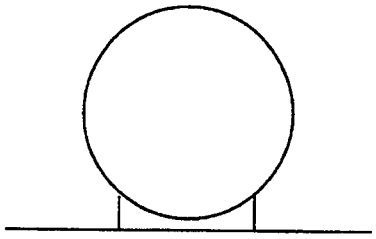
Figure 3.b
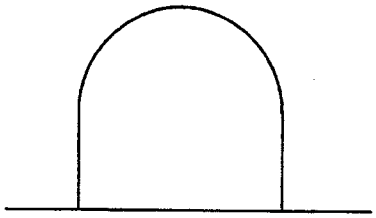
Figure 3.c
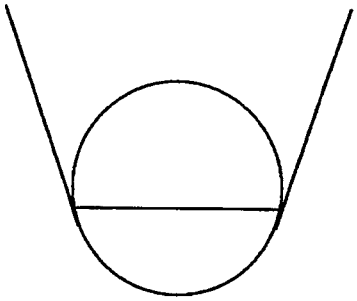
Figure 3.d

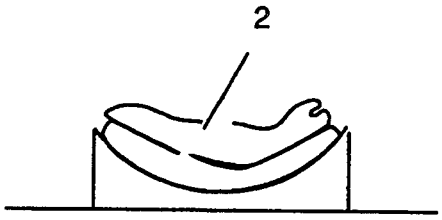
Figure 4.a
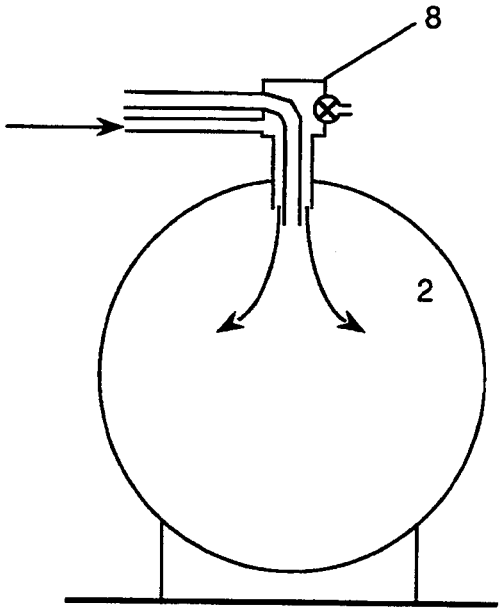
Figure 4.b
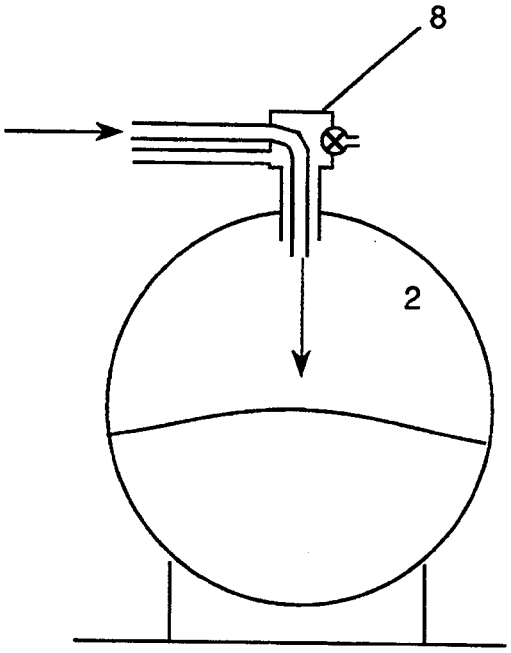
Figure 4.c

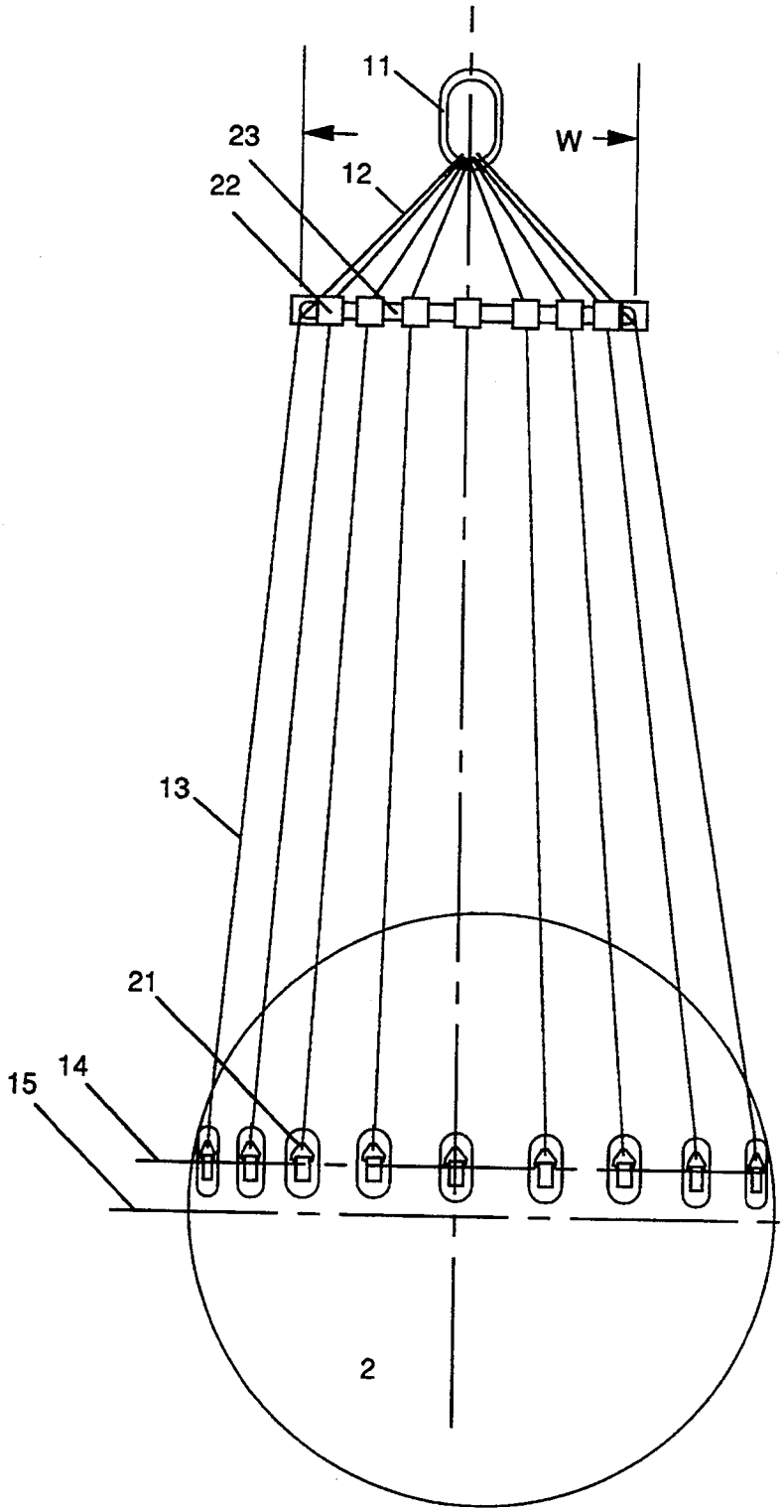
Figure 11.a
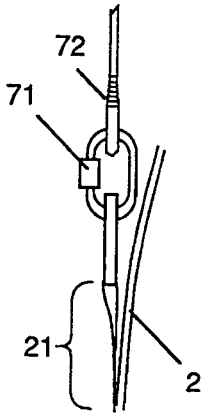
Figure 11.b

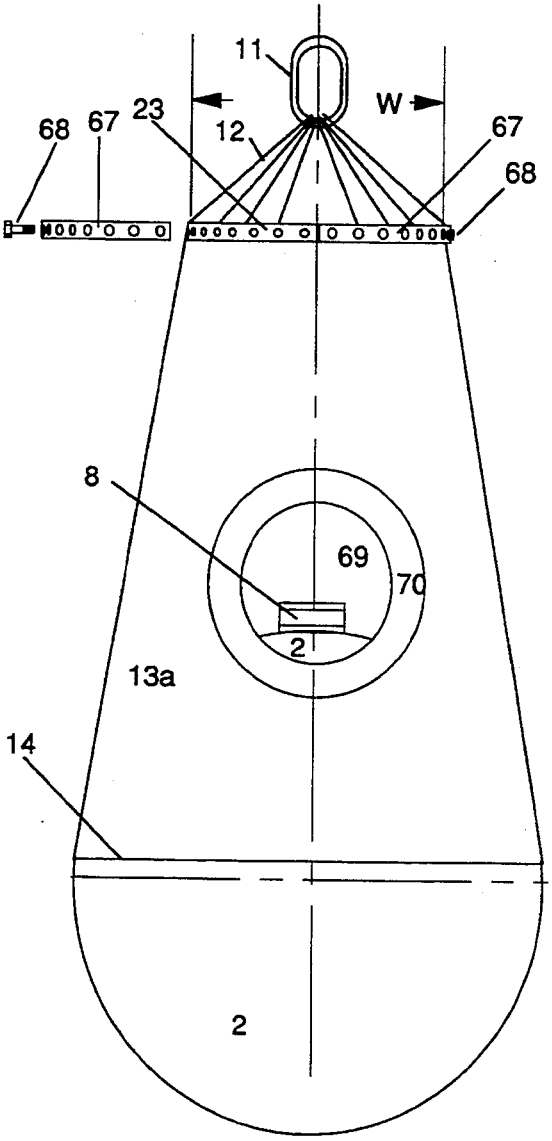
Figure 12.a
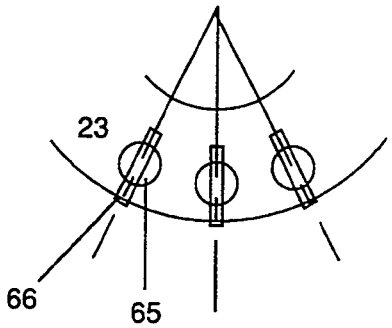
Figure 12.b
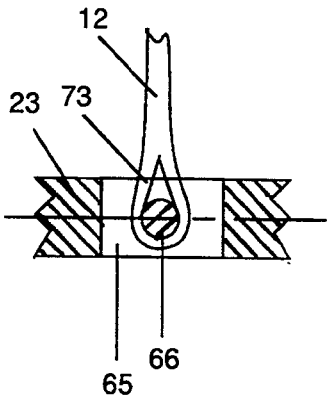
Figure 12.c

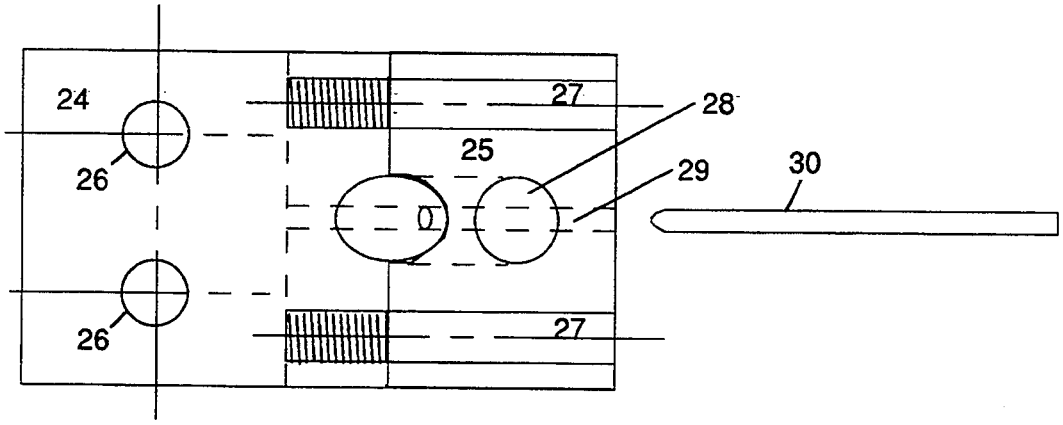
Figure 14.a
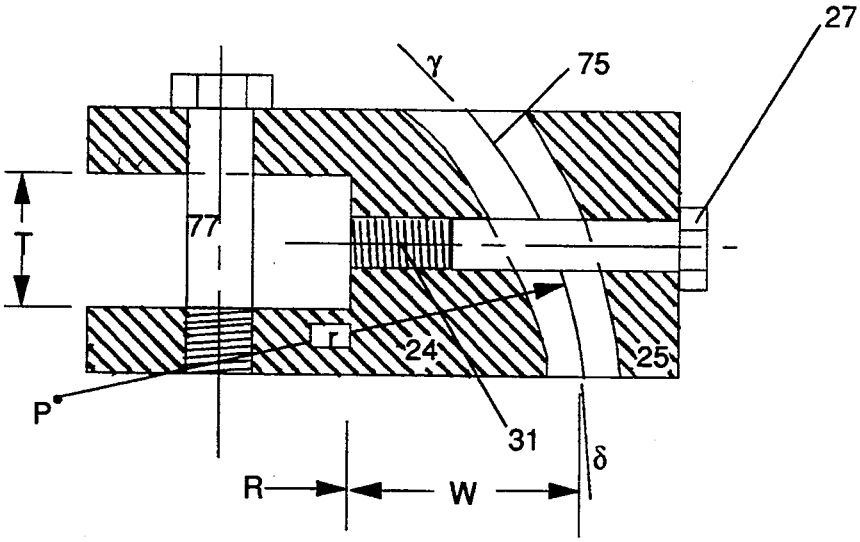
Figure 14.b
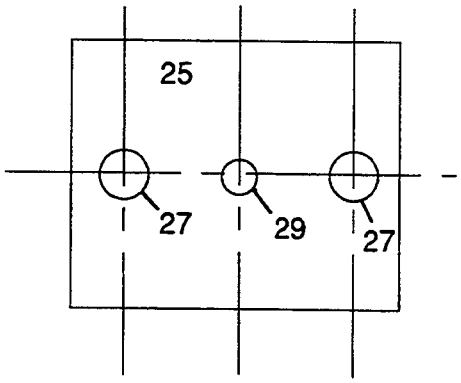
Figure 14.c

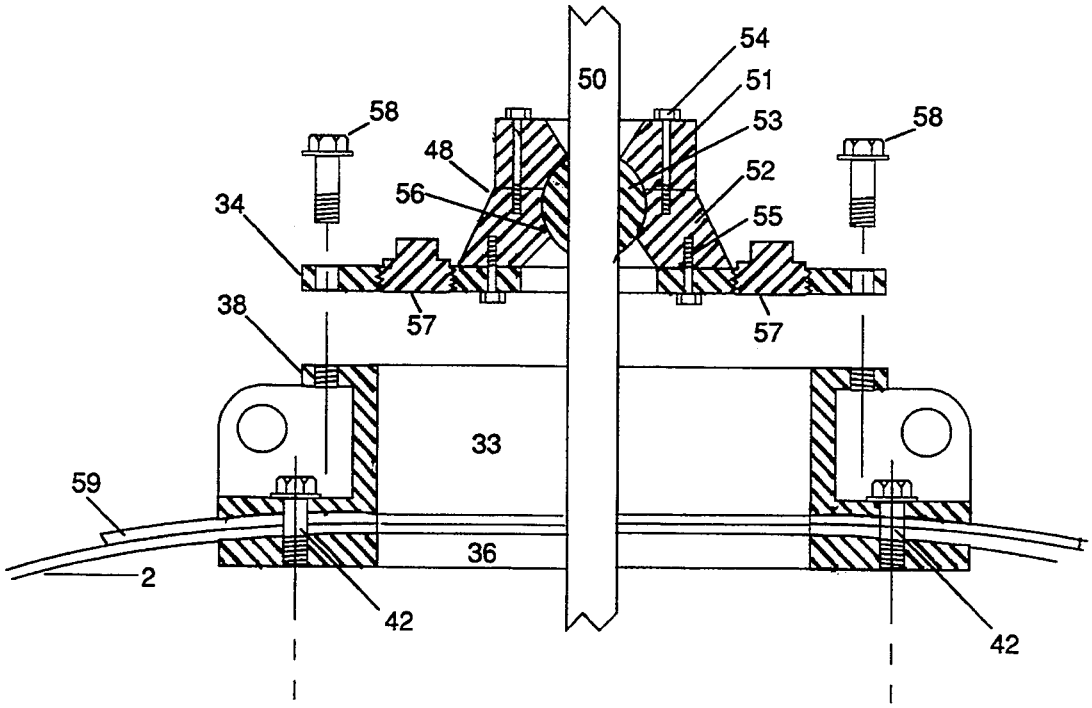
Figure 15.a
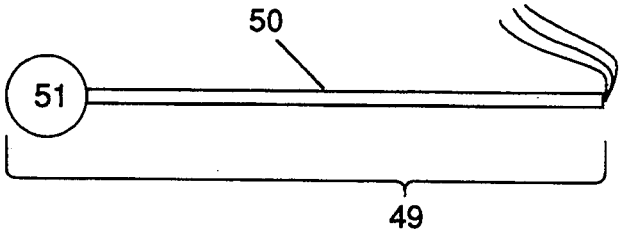
Figure 15.b

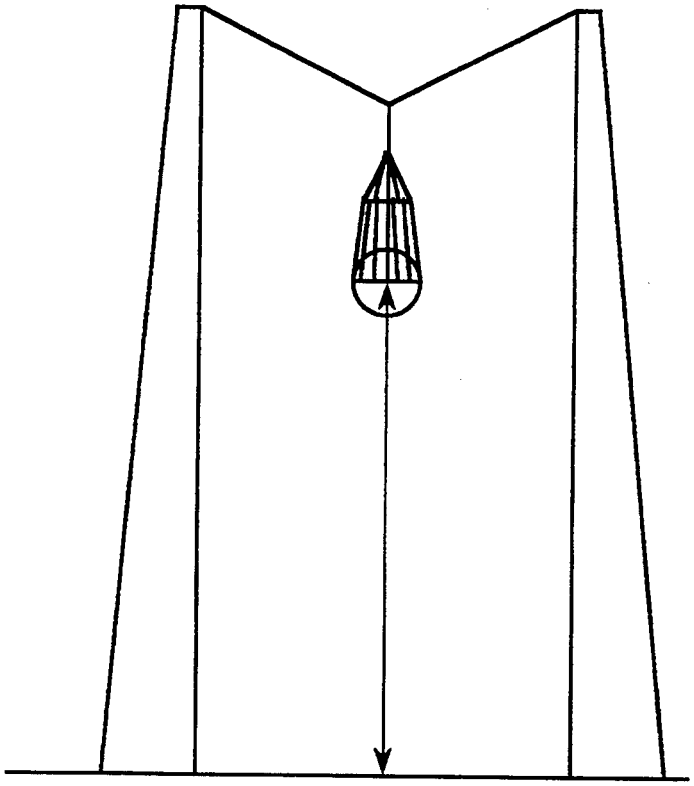
Figure 17.a
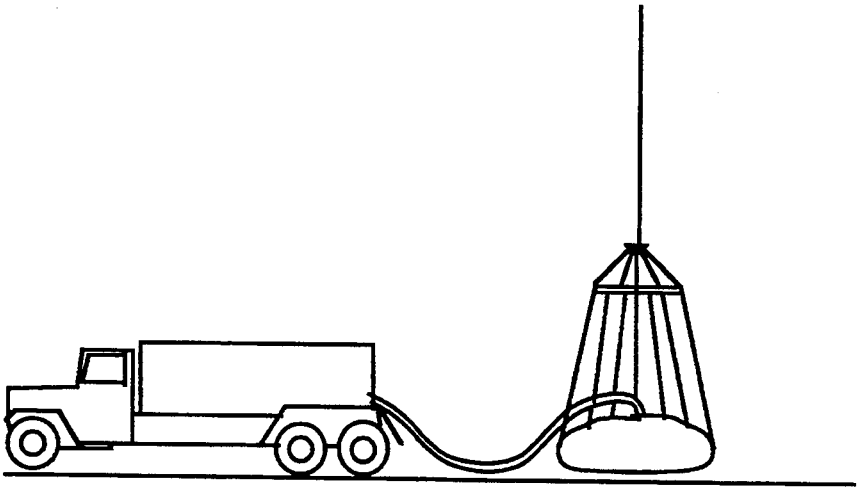
Figure 17.b

CONTAINER SYSTEMS FOR HIGH EXPLOSIVE TEST AGENTS

PURPOSE OF THE INVENTION

The following description and claims are for a device which can provide for a wide variety of explosive charge configurations, including a suspended spherical or elliptical charge, using a container system which provides minimum interference with the action of the explosive agent while allowing the use of inexpensive liquid or pourable explosive agents. Such agents include liquids ( nitromethane for example), emulsions or gels (ammonium nitrate, fuel oil, and water mixture for example), or pourable solids (ANFO for example). An important property of the class of devices covered by these clauses is that of introducing a minimum of contamination into the blast field created by the detonation of the explosive agent. Since such explosive charges will be used to create blast test conditions, it is important that no container system debris enter the blast test area, causing potential harm to the experiments and that the blast field not be distorted by the effects of the container. Therefore it is the objective of the device to impose a minimum of non-explosive mass of the containment system upon the overall mass of the system and its enclosed explosive agents.

PRIOR ART

ANFO high explosives were contained in a spherical fiberglass shell and suspended by means of a pole or tower through the center of the sphere. Ground supported spherical configurations in fiberglass containers have also been used. In these cases, the fragmented container and the ground support structures have resulted in significant interference with experiments located within the blast test area.

DESCRIPTION OF FIGURES

FIG. 1*a–c* illustrates the overall consumable HE container concept of he invention.

FIG. 3*a–d* exhibits the various configurations into which the invention may be arranged; (a) a ground supported hemisphere, (b) a pedestal supported sphere, (c) a silo design, or (d) a suspended sphere.

FIG. 4*a–c* shows a typical procedure for filing the container with an explosive agent.

FIG. 11*a,b* illustrates the suspension support subsystem along with a detail of the attachment means for joining the suspension lines and the container.

FIG. 12*a–c* depicts an alternate suspension system concept of the invention which utilizes a continuous fabric support element.

FIG. 14*a–e* depicts the spreader ring line attachment fixture from the top side, and one end.

FIG. 15*a,b* shows the integration of the filling port, top cover, initiator assembly, and initiator assembly clamping fixture.

FIG. 17*a,b* is a depiction of the overall operation of the container concept including the variable height of burst configuration and ground filling operations.

DESCRIPTION OF THE INVENTION

See attachment 1.

ATTACHMENT 1

Invention Description

1. Description of the Invention

The container system is composed of two major subassemblies, the container subassembly and the support subassembly, in addition, an initiator subassembly is used to detonate the explosive agent. The particular unique design features and claims of each are described in the following paragraphs.

1.1 Container Subassembly 1.1.1 Self explosive Wall Container

Figure 2:
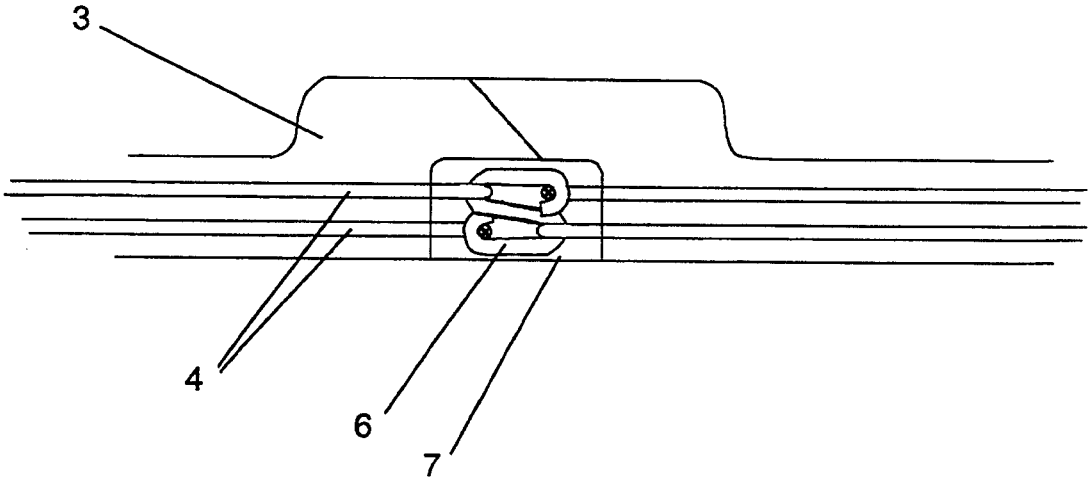
FIG. 2 shows the general means of assembly of the HE consumable container walls.

The container subassembly for any selected free-standing or suspended explosive configuration must, in general, be capable of sustaining tension, compression, and shear. A special set of cases is discussed later in which the container body need only sustain forces tension. The container material will either itself be an explosive device, or will be a thin coated fabric, either of which will either be entirely consumed in the explosive process or will add only a very small unconsumed mass to the explosive blast test area. In all cases, solid particles with significant mass and velocity will be absent from the test volume. In the self explosive embodiment case of this invention, (FIG. 1), the container may be of a generalized shape (1) or a body of revolution (2) whose walls can support tension, compression, and shear forces. The container walls will consist of a molded rubber or plastic based flexible or rigid explosive shell (3) reinforced with kevlar or other high strength low elongation synthetic fiber (4). Figure 2 shows that the container may either be constructed in one piece or may consist of a number of molded sections, joined by means of extended loops of the reinforcing material (6) which are locked together by means of a cord passed through the loops of adjacent sections. Other means of joining may also be used. The gap between the joined sections is then filled with the same type of explosive material used to form the sections of the container (7). In this embodiment of the invention the explosive container itself takes part in, and is consumed by, the explosive process, resulting in the desired minimum container impact upon the blast test volume created by the explosive device.

FIG. 3 illustrates the application of this embodiment of the invention to ground based systems which use the ground plan (A), (C), or a special support (B) as a means of support. Although spherical shapes are illustrated, arbitrary shapes can be used due to the ability of the reinforced explosive walls to support tension, or compression, and shear forces. Alternately, the container may be suspended in air or in a fluid (water) as shown in (D).

FIG. 4 illustrates a procedure for filling the container With an explosive agent. The container is placed on the ground or in its supporting (sketch 1) which may consist of either ground support (FIG. 3,B) or a suspension support (FIG. 3,D). If the container walls are flexible, a special filling fixture (8) is used to permit an initial extension of the container using compressed gas ($N_2$ or air) and subsequent filling with explosive agent while under pressure. The pressure may be necessary to assure proper filling of the flexible container with certain types of explosive agents, particularly loose solids such as ANFO, and is useful for testing. It should be noted that, for liquid agents which will not sustain shear forces, it may not be necessary to pressurize the container (1),(2) to obtain the proper shape and fill.

Figure 5:
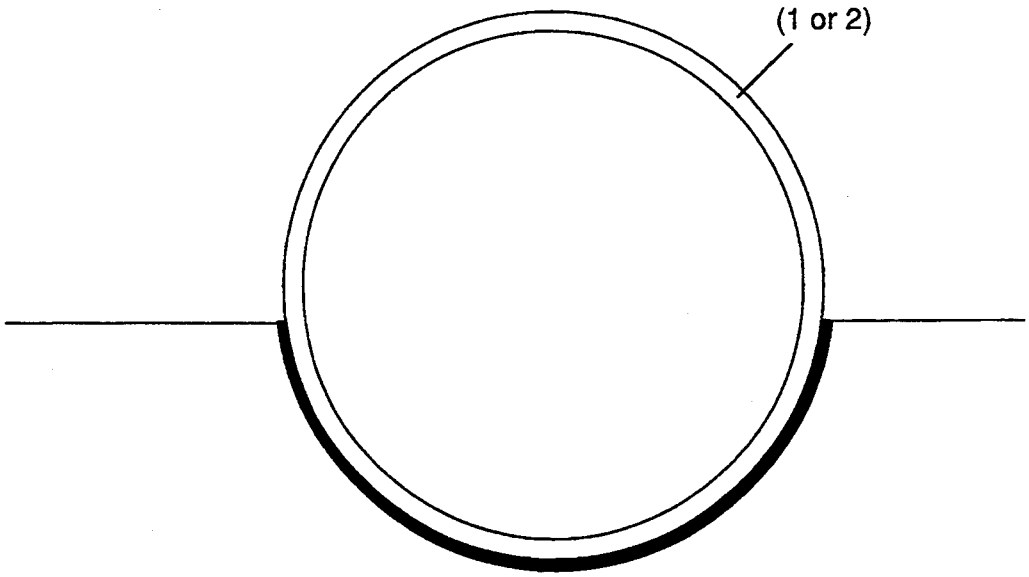
FIG. 5 illustrates the ability of the container walls to conform to an excavated hole in the ground.

FIG. 5 illustrates a particular method for installing the container subsystem (1),(2) within an excavated hole in the ground. In this case, the compliant nature of the containers wall will permit use of only a rough excavation and appropriate loose fill (sand, for example), thus providing additional cost savings over conventional systems requiring accurate excavation hole profiles.

1.1.2 Special Case of Spherical or Elliptical Suspended Container

Figure 6:
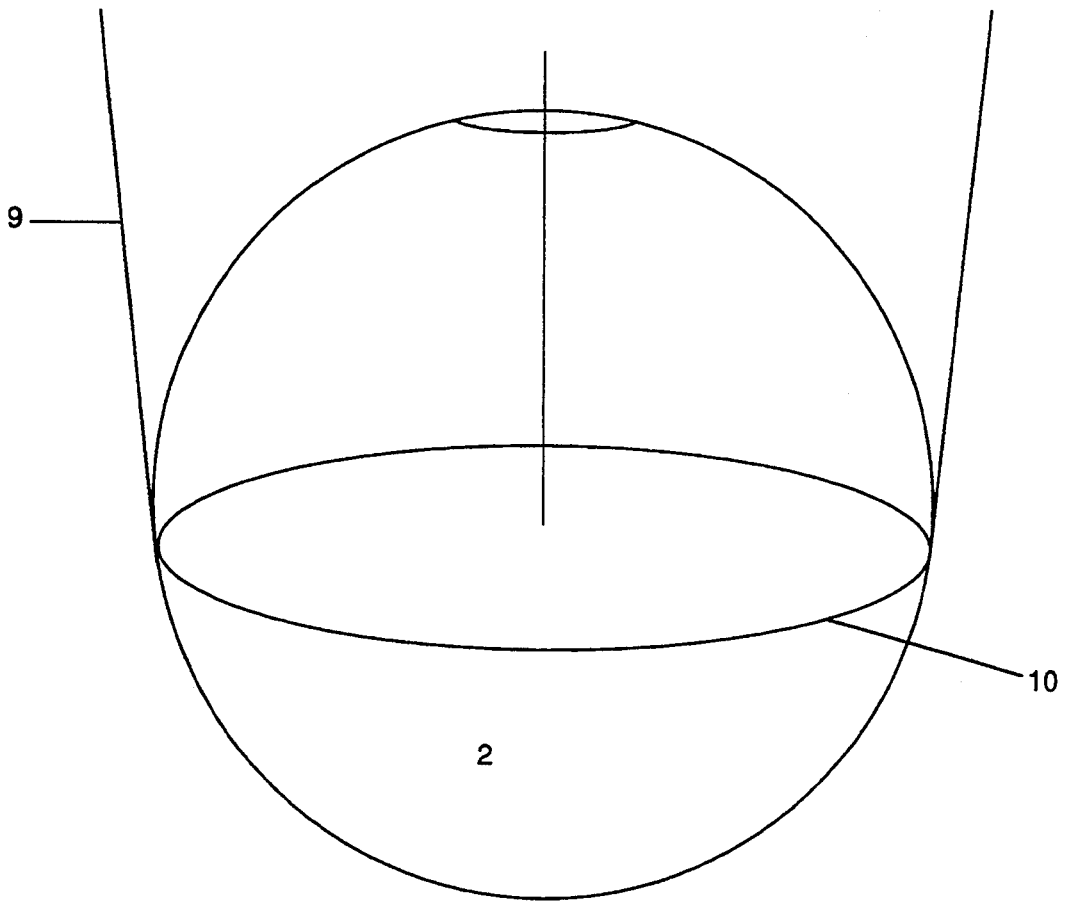
FIG. 6 depicts the suspended spherical configuration of this invention, where all container elements are held in tension only.

A special embodiment of this invention in the form of a suspended spherical or elliptical container is illustrated in FIG. 6. A set of conditions under which all elements of the container wall will be held in tension only will exist when the container is filled with a fluid (i.e., the explosive agent will not sustain shear forces within itself) and properly suspended from its periphery. In this case, a fabric or coated fabric thin wall container without explosive coating or shear sustaining walls will successfully contain the explosive. The design of the container will be such that, when filled with the liquid agent, the container under the imposed load stress will elongate to assume the final desired shape of the test explosive charge.

For the special case container wall to be everywhere in tension, it must be supported about a latitude line forming a plane perpendicular to the force of gravity and to the vertical axis of the container, which latitude must be lie between 20 degrees south (below) the equator and 8 degrees north of (above) the equator. The means of suspension may be either a cylinder or cone of material or a set of shroud lines (9) which must be attached to the container at the latitude support line (10) and exert tension in support of the container along a vector which is tangent to the container surface at this latitude line. In other words, the support subsystem (fabric or lines) is tangent to the surface of the container subsystem (2) at the attachment point (10).

Figure 7:
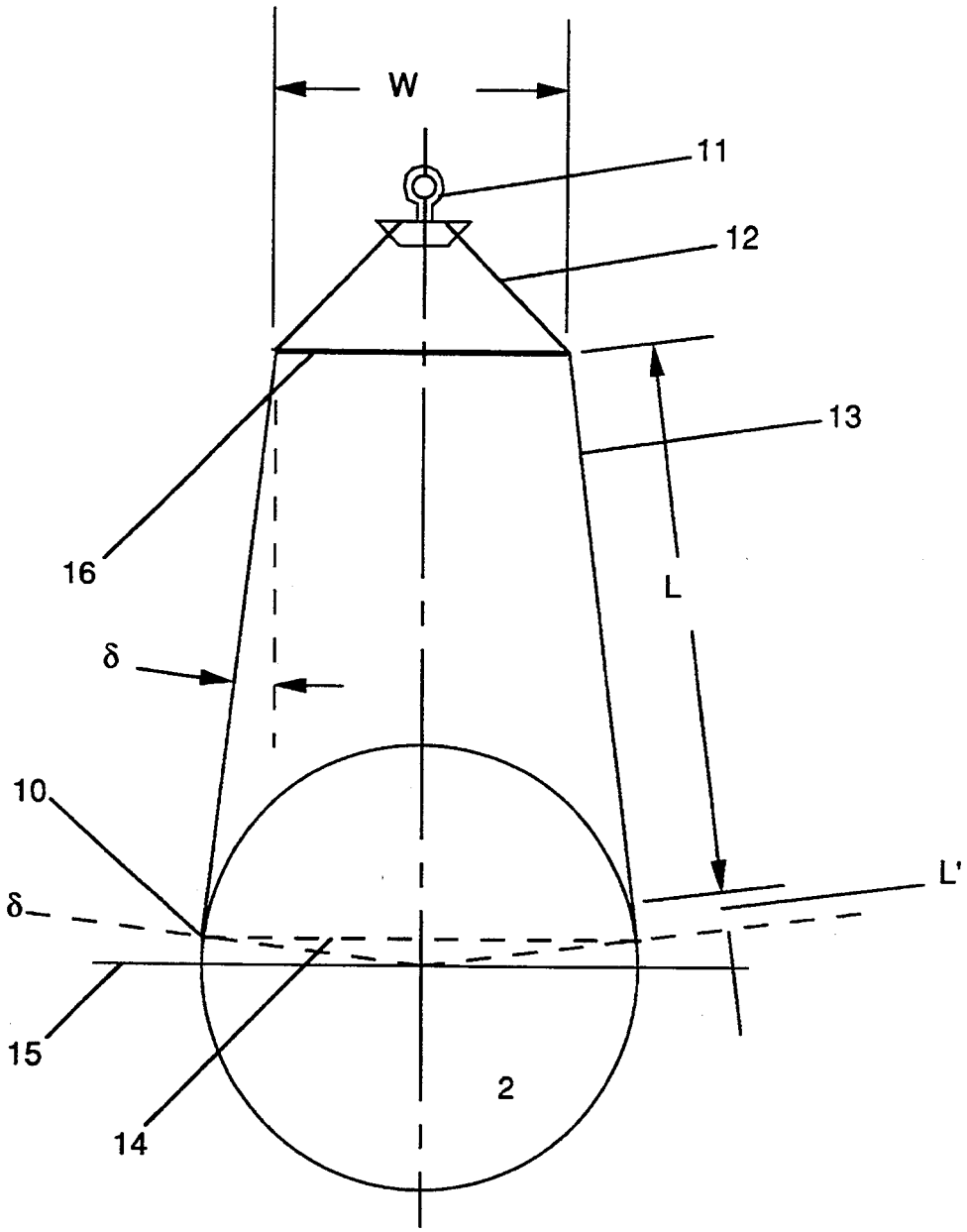
FIG. 7 shows the integration of the container and suspension subsystems for the suspended spherical configuration.

The integration of the container subsystem and the suspension subsystem is illustrated in FIG. 7. The overall length of the suspension support subsystem can be shortened through the use of a Single point suspension fixture (11) and a spreader ring (16) whose effective diameter (W) provides the proper angle for the suspension fabric or length line (12) from the single point suspension to the spreader ring (16) and for the fabric or line length (13) leading from this ring to the attachment point (10) located at the attachment latitude (14), which is $\delta$ degrees above the container equator (15). The angle $\delta$ and attachment latitude (14) for the configuration will lie between 0 degrees (the equator (15)) and 8 degrees for a spherical contains subsystem (2). The total length of the support system must include that of the attachment means (L') and the length of line or fabric L.

Figure 8:
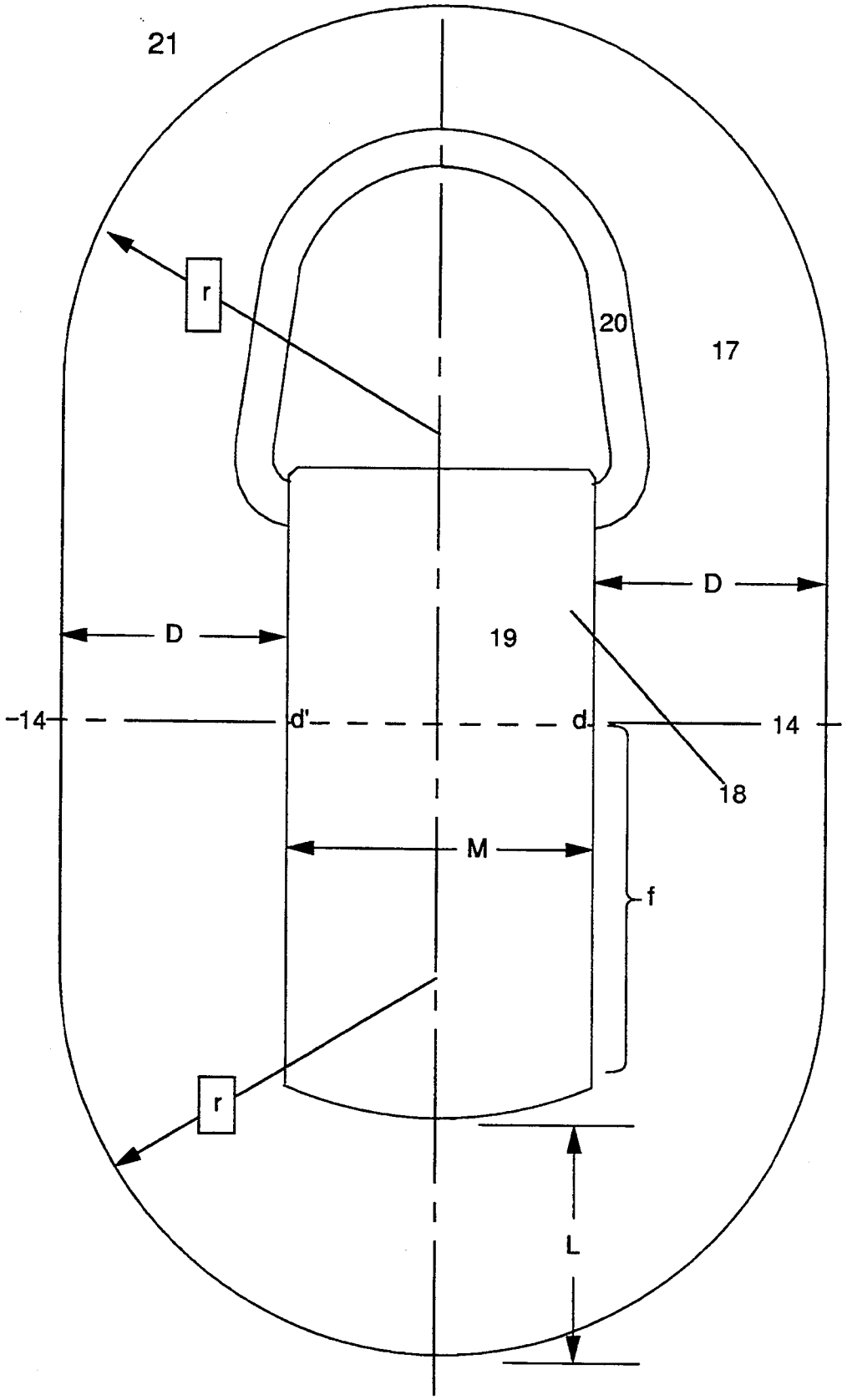
FIG. 8 illustrates the attachment means for the special thin wall embodiment of the invention.

FIG. 8 illustrates the attachment means ( attachment subassembly [21]) used for the special thin wall embodiment of the invention. An attachment base [17] is bonded to a suspension strap [19 ] which is folded to form a loop [18 ] which retains a suitable attachment ring [20] which may be connected to suspension lines (see 13 in FIG. 7) by appropriate means (carabiniers or "quick links"). The strap [19]is bonded to the base [17] such that the uppermost extent of the bond (d—d') lies along the attachment latitude [14 ] of the container.

The general dimensions of the attachment subassembly are such that the strap width M is approximately equal to (or less than) the extent of the base to each side of the strap [D] and the extent of the base to the bottom of the strap [L], for adequate distribution of suspension stress to the container wall. The base [17] may be rounded at radius [r] for ease in installation and can be extended above the top of the attachment ring [20] to protect against chafing by the support subsystem lines and attachment devices.

1.1.3 Container Filler Port Assembly

Figure 9:
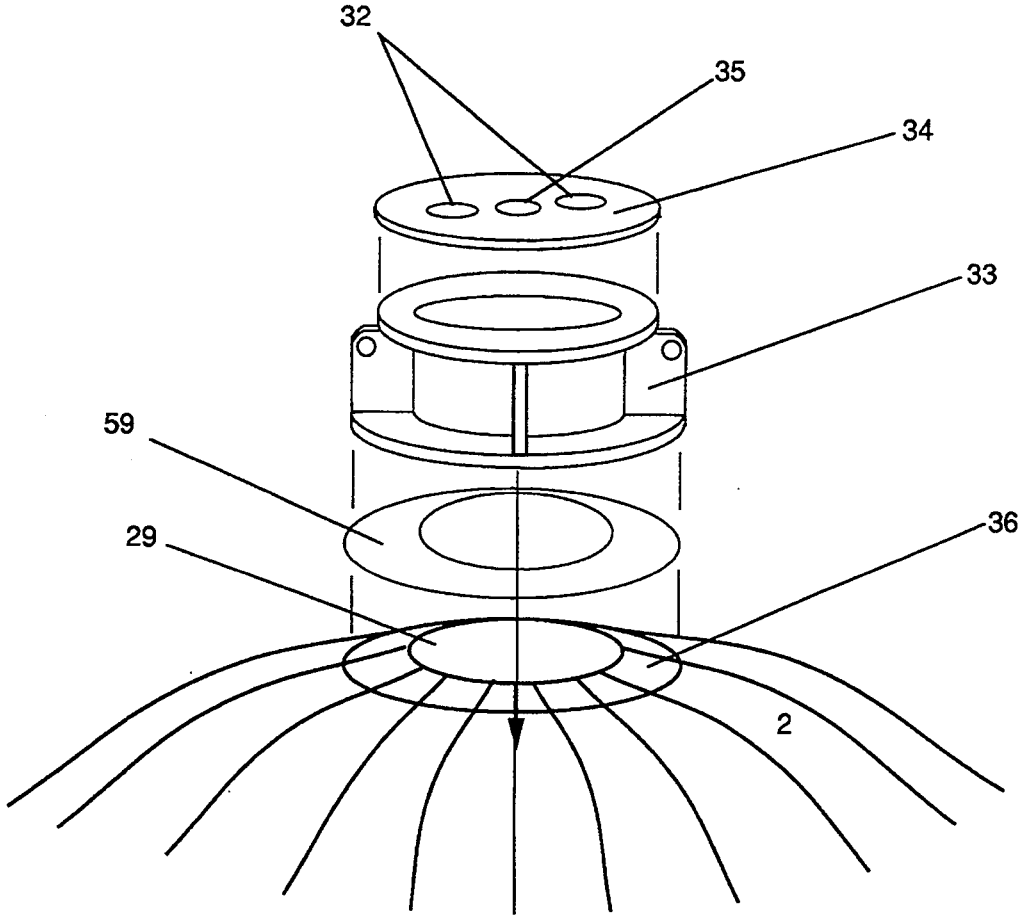
FIG. 9 is an exploded view of the container filler port assembly.
Figure 10:
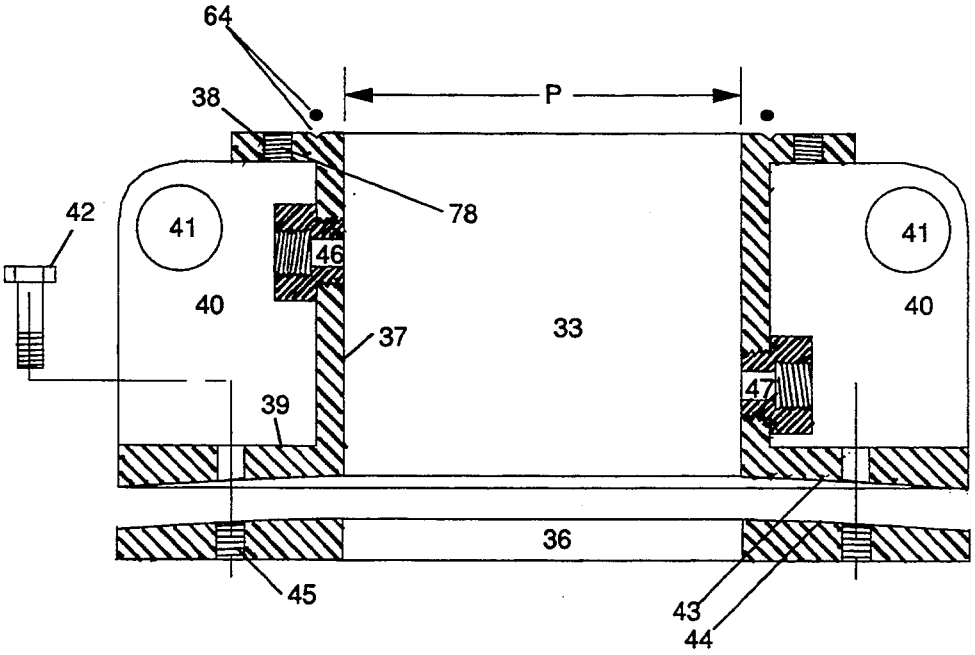
FIG. 10 shows a more detailed depiction of the top filler port assembly.

For the general case of the explosive reinforced (sheer and compression bearing) container and the special case of the suspended (tension only) all fabric container, a filler port fixture is attached and shown in FIG. 9. The filler port consists of an upper body (33), a bottom filler port clamp (36) (see FIG. 10) which may be split for insertion into the fill hole (29) of the container (1),(2) and a top cover plate (34) which contains provisions for supporting the initiator subsystem (35) and filling access (32). The particular features of the filler port assembly are shown in FIG. 10.

1) A bottom filler port clamp (36), which may be split is threaded (45), to receive securing bolts (42) inserted through the bottom flange (39) of the filler port body (33) and corresponding container (2). (As shown in FIG. 9).

2) A neck (37), filled with appropriate pressurization (46) and spillover (47) (drain) fittings.

3) A top flange (38) to which the top cover plate (34), carrying the initiator subassembly, is fitted by means of threads [42] and bolts [FIG. 15:58] and embodying an O-ring, or other sealing means, to assure as air tight fit of the initiator assembly to the fill port fixture.

4) The top (38) and bottom (39) flanges and neck (37) form an integral assembly of the filler port upper body (33).

In addition to the above features, the filler port assembly includes four "ear" reinforcements (40) equally or appropriately spaced about the periphery of the filler port with a hole [41] so that lines may be attached to support or position the filler port for explosive agent filling, initiator insertion, and other operational requirements. These ears also reinforce the upper [38]and lower [39] flanges. Note that when the cover [34] and the initiator assembly is fully installed and sealed, the container may be pressurized, which pressure will then support the filler port fixture and the initiator independently of any special support used during filling or initiator installation. In the event the container is not pressurized, the aforesaid support "ears" [40] may to be used, to provide such support.

1.2 Suspension Subassembly

In the special embodiment of thin walled tension only suspended explosive charge systems, where the charge is suspended against the force of gravity within any fluid or gaseous medium (water or air, for example), this invention uses a special suspension support subsystem embodiment. The suspension support subsystem is illustrated in FIG. 11, using a number of lines as support elements, and in FIG. 12 using a continuous fabric support element.

An attachment means [21] to transfer the weight of the container to the support subsystem is provided as a part of the container subassembly. A set of support lines [13] are attached to these means [21] using carabiniers or "Quick links", which are standard hardware items, and eyes [72] spliced into the lower termination of the suspension lines [13]. For an explosive wall container of arbitrary shape, the suspension latitude line will be any appropriate section of a horizontal plane [14] (perpendicular to the gravity vector) through the walls of the container. For the special case of the thin wall tension only (coated or uncoated) spherical or elliptical container, the preferred latitude line will be as described in 1.1.2.

Referencing FIG. 11, the supporting (shroud) lines [13] are carried through and fixed at a spreader ring assembly which consists of a spreader ring (23) and a spreader ring attachment fixture (22) which provides for guiding the line around the spreader ring at the required diameter (W) and fixing the line to the ring so that it does not slip and so as to minimize any strength loss to the supporting lines as a result of the fixing means. The supporting lines are then carried [12] to the single point suspension fixture [11]. In the illustration, a single "master link" (standard hardware) is used for the single point suspension. The suspension lines [12] are attached to the "master link" by means of eyes spliced into the line.

FIG. 12 illustrates an alternate support subsystem design which is another embodiment of the invention for suspended thin walled tension only suspended containers. In this embodiment, a cone of fabric material [13] similar to that of the container is bonded (attached) to the container at the preferred attachment latitude [14] continuously around the entire periphery of the container. This provides the most uniform distribution of stress around the container, minimizing distortion of the container due to stress differences. It's disadvantage is the limited access it offers for filling the container and inserting and aligning the initiator subsystem.

In this embodiment, the upper portion of the crucial support fabric [13*a*] is attached to the spreader ring [23] by means of split clamping rings [67] and bolts [68] threaded into the spreader ring at appropriate intervals and through matching holes in the supporting fabric cone [13*a*]. An access port hole [69] is provided for filling and for initiator subsystem insertion, reinforced by a fabric or other material ring [70] which helps transfer the support stress around the access hole [69]. The spreader ring is modified to accept and hold the support lines [12] from the spreader ring to the single point suspension. The lines [12] have spliced eyes in both ends. The upper eyes are permanently spliced to the single point suspension fixture and the lower eyes [73] are secured to the spreader ring by means of a pin [66] passing through a light press fit hole whose axis lies along a radius of the spreader ring and passes through a clearance hole [65] for the eye.

Figure 13:
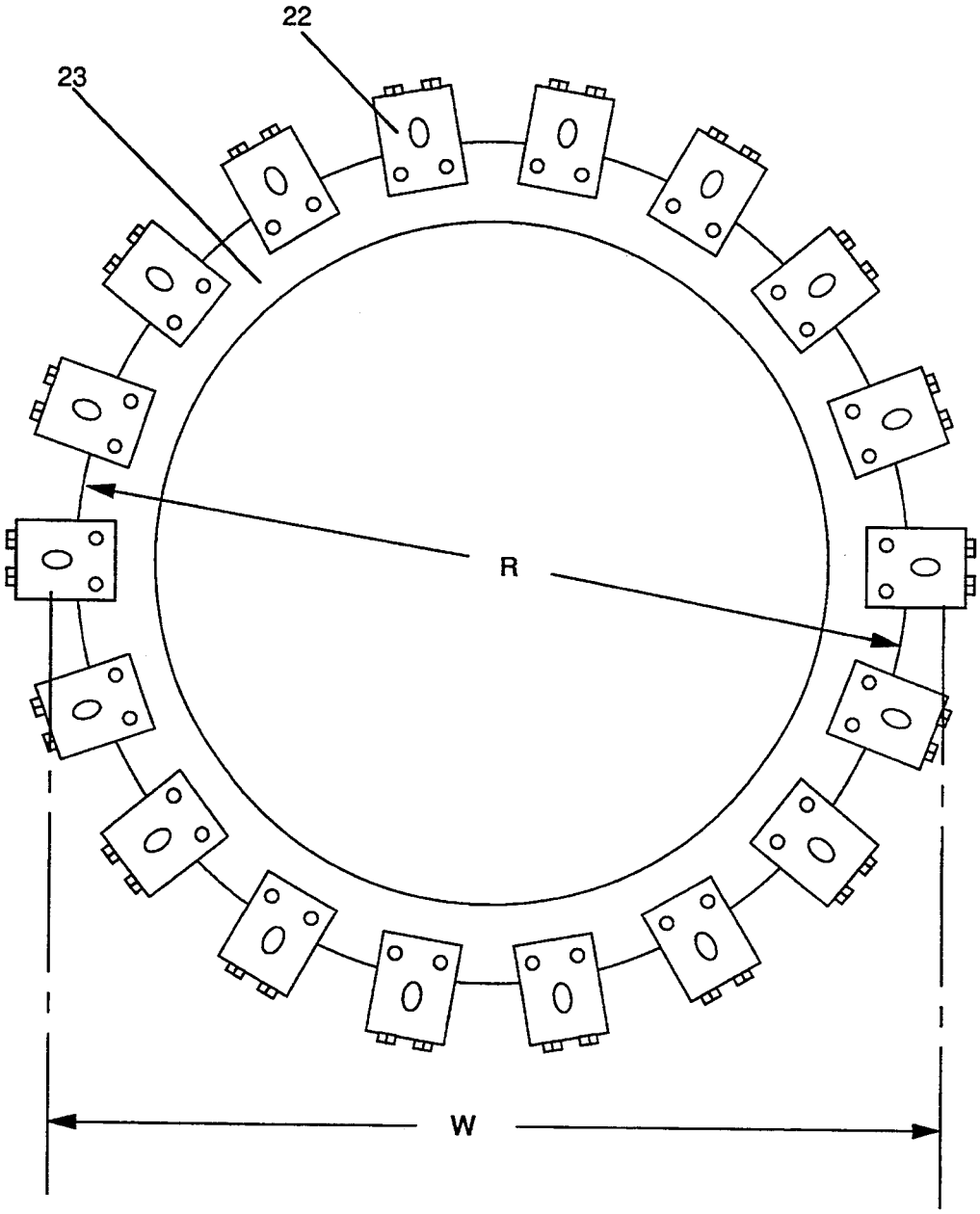
FIG. 13 shows the spreader ring assembly for the line supported embodiment of the invention.

2) FIG. 13 illustrates the spreader ring [16] assembly for the line supported embodiment. This fixture permits the supporting lines to assume a tangent to the surface of the container at the latitude line attachment location. The body of the spreader ring [23] will correspond in shape to the cross section of the container at the attachment latitude line and will be of sufficient diameter [R] as to effect the proper suspension angle of the suspension lines or fabric at the attachment latitude line (i.e., at a tangent to the container surface at that point).

A special line attachment fixture [22] is provided as a part of the spreader ring fixture to lead the line at minimum loss of strength from the single point suspension to the suspension line angle with the container vertical axis at the attachment point. (Angle $\delta$, FIG. 7). In conjunction with the spreader ring body [23], this fixture establishes a spreader diameter [W] for the suspension lines [FIG. 11:13]. The spreader ring line attachment fixture [22] is shown in FIG. 14 and consists of a metal or reinforced plastic block [24], [25], notched to clamp onto the spreader ring body [23] (FIG. 13:23), by means of bolts [28] through holes [26] in the block (24), and having a curved hole [28] at a radius [r] of at least $4\times$ the line diameter leading the line through the appropriate change in angle. For maximum line strength, the diameter of the curved hole [28] is to be approximately 120% of the line diameter. [P] of this radius [r] is such as to produce the desired entrance angle $\delta$ of and exit angle $\delta$ to meet the geometry of the particular dimensions desired for the suspension support subsystem Typical angles are: $\delta=45°$, $\delta=7°$. A locking pin [30] is provided to secure the line [29] to the spreader ring. This pin is a light press fit into a hole which penetrates the clamp. The pin is rounded at the end to be driven through the line. The pin diameter is to be approximately $\frac{1}{3}$ of the diameter of the secured line. The principle of the locking pin is that, with a woven support line (FIG. 11:12,13), the pin will displace and lock the woven yarns of the line without damaging them. The entrance and exit of the curved line hole [28] are rounded to approximately 10% of the line radius to guard against chafing. To facilitate the fabrication of the curved hole [28], the block may be made in two pieces. the main body ("PART A"—[24]) is turned to produce one half of the curved mating surface [25] and the hole [28]. The clamping body ("PART B"—[25]) is cut from a bored piece or otherwise shaped to match the mating surface and to produce the outer portion of the curved hole [28]. The two block parts may be joined by various standard means including the use of twin bolts [27] threaded into the main body [31], part A [24]. The fixture [22] is attached to the spreader ring using two bolts [77] and corresponding holes [26] in the body [24] and the spreader ring [23]. A notch in the main body is cut to match the thickness [T] and profile of the spreader ring body (FIG. 13:23)and of sufficient depth to meet strength requirements.

1.3 Initiator And Holding Fixture Subsystem

The initiator subsystem [49] and holding fixture, as associated with the filling port [33] and filling port cover [34] are illustrated in FIG. 15. The initiator assembly consists of a molded sphere of appropriate castable high explosive [51] (pentolite, for example) and an attached section of stainless steel or other appropriate metal tube [50]. The tube [50] allows access for the insertion of an ignition means (i.e., blasting cap or exploding bridge wire) and the leads or fuse connection to the ignition means.

The holding fixture consists of a collect type clamping ball joint [53] through which the long suspension tube [50] is passed. The ball [53] is slotted in its upper hemisphere to facilitate its clamping action on rod [50]. This ball joint is clamped into position by a two piece block [51], [52]. The upper block [51] is compressed against the slotted hemisphere of ball [53] to lock the position of rod [50] using locking screws [54] which are threaded into the lower block [52]. The lower block [52] may be separately bolted to the cover plate [34] or may be an integral part of the cover plate. The ball is sealed by means of an "O" ring [56] imbedded into the lower body [52]. The cover plate [34] mates with the upper flange of the filling port assembly on the container [2]. This plate also contains two threaded plugs [57] which can provide access for "topping off" the explosive fill up the container after the initiator is inserted in the filled container. As previously noted, a reinforcing fabric ring [59] can be bonded to the container [2] to strengthen the filling port attachment.

Figure 16:
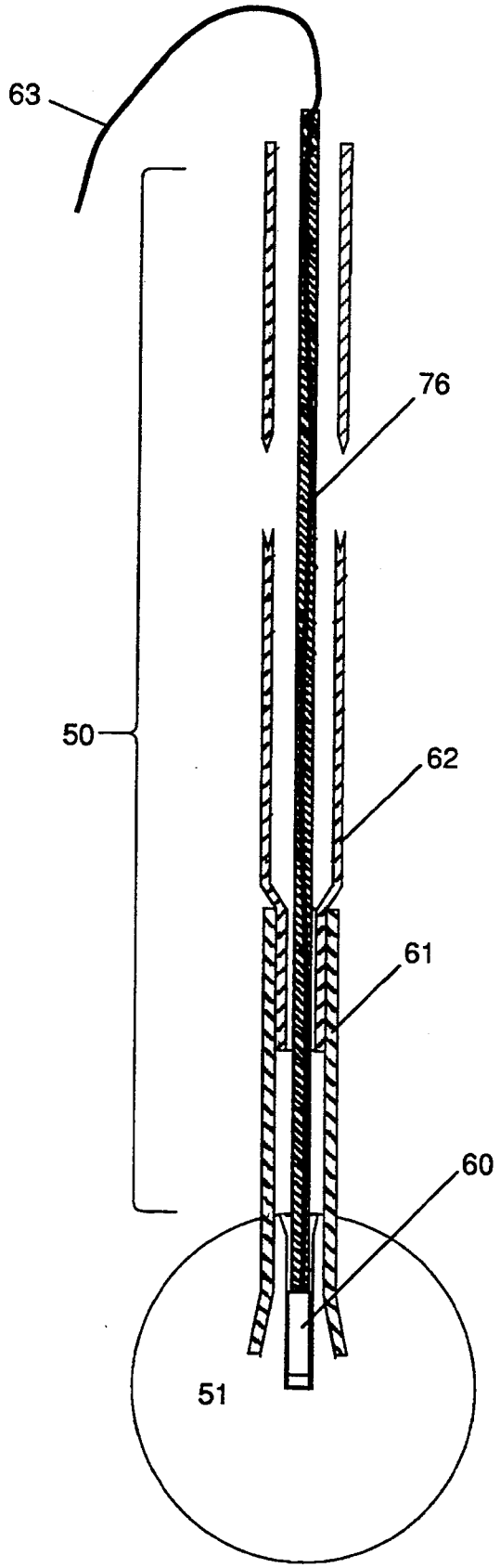
FIG. 16 illustrates the initiator sub-system.

FIG. 16 illustrates the initiator assembly in detail. The high explosive booster charge [51] is directly molded to a short section of tube [61] which is joined to a larger section of tube [62] using suitable attachment means (clamp, screw, rivet). The combined rod assembly [50] should be impervious to the explosive agent fill in the container. A hole is molded or fabricated into the booster charge [51] at an appropriate shape and depth to receive the ignition means [60]. To aid in final insertion, the ignition means [60] is attached to a small diameter plastic or wooden rod [76], which can be inserted through the tube [50] as a last "arming" step before setting off the explosive agent. Electrical or other firing connection leads from the ignition means lead out to appropriate connections through the tube [50].

2. Operation of the Container System

The operation of the system in use is depicted in FIG. 17. The container subsystem, suspension subsystem, and initiator are shipped to the test site separately. At the test site, the container is attached to the suspension system using the attachment means. The single point suspension (master link) is then attached to the raising means for suspended container and raised sufficiently that the unfilled container fill port is upright and the container body just off the ground. The container is than filled. To aid in filling, additional suspension lines may be attached from the spreader ring to the support "ears" on the filler port. When full, the container will have assumed its desired shape. The initiator is then inserted and the initiator plate attached to the filler port upper flange by means of bolts. The position of the initiator within the sphere is determined by the angle and length of the support tube extending from within the container so that it can be viewed and measured externally. Wires from the electric bridge wire (EBW) or other ignition device are led to the firing box through the suspension tube. The container is then lifted to the desired height (or position within the test medium) and fired.

In situations where the container system is not suspended, but positioned resting on a ground plane or within a supporting cavity, the empty container is emplaced, then filled, and the initiator inserted as noted in 2.3 and 3. above. For reinforced explosive wall containers, the assembly and final binding is normally to be done at the site with appropriate curve time before emplacement and filling.

We claim:

1. An explosive container system, for the containment of liquid, unconsolidated, or granular explosive agents, comprising:

a. one or more consumable container wall segments, which combine a suitable rubber or polymer based explosive with inert internal or external reinforcing cords or fabric, to form a container whose walls can support both tensile and sheer forces, b. a set of loops or other attachment means formed by extension of the reinforcing cord or fabric from the edges of said wall segments, c. a locking cord for securing the container wall segments to each other, d. an air-curing cross-linked polymer based explosive or otherwise consumable filler to seal the securing joints formed by said attachment means and said cord between said consumable container wall segments, e. a filling port, said port providing an entry port for the introduction of the explosive agent used to fill the container and a valve controlled means of pressuring the assembled container to facilitate the filling process.

2. A single piece container system, as in claim 1, comprising:

a. a closed container formed in any closed shape from a suitable rubber or polymer based explosive with inert internal or external reinforcing cords or fabric, to form a container whose walls can support both tensile and shear forces, b. a filling port, said port providing an entry port for the introduction of the explosive agent used to fill the container and a valve controlled means of pressuring the container to facilitate the filling process.

3. An explosive container system comprising:

a. a spherical or ellipsoidal bag, constructed of overlapping gores or continuously wound or woven fabric, coated or uncoated, b. a suspension system for supporting said bag from a single suspension point, a filler port attached to the top of said bag and providing filling access to the bag, d. an initiator system providing for the ignition and detonation of the explosive filler placed in said bag.

4. An explosive container system as in claim 3, and further comprising:

a. an attachment means for attaching the container bag to the suspension system, b. said attachment means using the same or similar material used to construct said bag to form a loop or eye for attachment to said suspension system, c. a metal or composite material ring incorporated in the loop or eye of said attachment means to attach said bag to said suspension system, d. an opening at the top of the said bag to permit the introduction of the explosive fill agent and the means of igniting and detonating said fill agent, a reinforcing ring of fabric or plastic material attached to said bag about said opening.

5. An explosive container system as in claim 3, and further comprising:

a. a filler port having upper and lower attachment flanges and attached to said opening at the top of said bag, b. said filler port having a neck extending between said upper and lower flanges, c. two or more support means in the form of vertical reinforcing blocks with attachment holes arranged about said filler port neck, d. an outflow port for the release of liquid explosive agent from said neck of said filler port, located on said neck, e. a pressure port located on a plane higher than that of said outflow port, for admitting air or other gas for the pressurization of said bag, located on said neck, f. a cover plate to be attached to said upper flange of said filler port, g. an O-ring groove and O-ring to provide a pressure seal said between said upper flange and said cover plate.

6. An explosive container system as in claim 3, and further comprising:

a. a suspension system as in claim 3.

b. a single point suspension means consisting of a metal or composite material ring or other shape, c. a set of supporting lines which are eye spliced or otherwise attached to said single point suspension means, d. a spreader ring to extend said supporting lines to the proper suspension geometry, e. a set of line attachment fixtures attached to, or an integral part of, said spreader ring, f. a curved passage through said line attachment fixtures for guiding said supporting lines through said fixtures and around said spreader ring, g. a set of locking pins, passing through said curved passages of said line attachment fixtures and said supporting lines within said curved passages, to lock said lines in position with respect to said spreader ring, h. a spliced eye at the extreme end of each said supporting line, i. a carabiner or other mechanical link means to connect said supporting line eyes to said bag attachment means;

7. An explosive container system as in claim 6, and further comprising:

a. a set of upper supporting lines attaching said single point suspension means to said spreader ring and eye spliced to said single point suspension means, b. a continuous fabric conic section attached to said spreader ring and extending from said spreader ring to said bag attachment means, c. an access port in the side of said fabric conic section, d. a reinforcement ring attachment about said access port, e. a set of transverse pins within said spreader ring for securing said upper supporting lines to said spreader ring, f. a series of clearance holes through which said upper supporting lines pass for attachment to said transverse pins, g. eyes spliced to the extreme ends of each of said upper supporting lines for attachment to said transverse pins.

8. An explosive container system as in claim 1, claim 2, or claim 3, and further comprising:

a. an initiator assembly which is inserted through said filler port into the interior of said bag or said container, b. an cylindrical initiator assembly rod which holds the ignitor or detonator and explosive booster within said bag or said container and which provides a conduit for ignitor or detonator and instrumentation wiring from the interior, through said filler port, to conventional external connection means, c. an internal ignitor/detonator rod which is attached to the ignitor or detonator for inserting said ignitor or detonator into or adjacent to said booster explosive, through said initiator assembly rod.

9. An explosive container system as in claim 1, claim 2, or claim 3, and further comprising:

a. an initiator holding fixture, b. a spherical retaining ball within said fixture with a bore through which said initiator assembly rod passes, c. a set of slots in the upper hemisphere of said retaining ball, d. an O-ring and O-ring slot within said retaining ball bore, e. a base plate within said fixture for attachment to said filler port, f. a hole and corresponding spherical surface, attached to or as an integral port of said base plate for retaining said retaining ball, g. an O-ring and O-ring slot within said spherical surface of said base plate, h. a clamping plate within said fixture with a central hole and concentric spherical surface for clamping said retaining ball to said base plate and to said initiator assembly rod, i. a set of clamping screws for securing said clamping plate to said base plate and said retaining ball, j. one or more ports for insertion of explosive filler agent through said base plate into said filler port.

* * * * *